US008393025B2

(12) United States Patent
Crispino et al.

(10) Patent No.: US 8,393,025 B2
(45) Date of Patent: Mar. 12, 2013

(54) BED COVERING SYSTEM

(75) Inventors: Kathleen M. Crispino, Bristol, CT (US); Dennis Crispino, Bristol, CT (US)

(73) Assignee: KaDe Enterprises LLC, Bristol, CT (US)

( * ) Notice: Subject to any disclaimer, the term of this patent is extended or adjusted under 35 U.S.C. 154(b) by 274 days.

(21) Appl. No.: 12/603,699

(22) Filed: Oct. 22, 2009

(65) Prior Publication Data

US 2010/0154122 A1 Jun. 24, 2010

Related U.S. Application Data

(60) Provisional application No. 61/139,948, filed on Dec. 22, 2008.

(51) Int. Cl.
*A47C 31/00* (2006.01)

(52) U.S. Cl. ..... 5/500; 5/494; 5/497

(58) Field of Classification Search ..... 5/482, 485, 5/490, 493–502, 413 R, 413 AM
See application file for complete search history.

(56) References Cited

U.S. PATENT DOCUMENTS

| | | | | |
|---|---|---|---|---|
| 2,789,292 | A | 4/1957 | Budinquest | |
| 3,083,378 | A | 4/1963 | Pursell | |
| 3,530,487 | A | 9/1970 | Beer | |
| 3,962,739 | A | 6/1976 | Crockett | |
| 3,965,504 | A | 6/1976 | Ainsworth | |
| 4,145,778 | A | 3/1979 | Ferrante et al. | |
| 4,161,044 | A | 7/1979 | Bogle | |
| 4,241,466 | A | 12/1980 | Mendyk | |
| 4,266,308 | A | 5/1981 | Shatz | |
| 4,304,018 | A * | 12/1981 | McClam | 5/494 |
| 4,384,380 | A | 5/1983 | Glaha et al. | |
| 4,546,508 | A | 10/1985 | Ison | |
| 4,615,061 | A | 10/1986 | Scott | |
| 4,658,454 | A | 4/1987 | Potter | |
| 5,020,177 | A | 6/1991 | Etherington | |
| 2,567,072 | A | 9/1991 | Kay | |
| 5,084,929 | A | 2/1992 | Staudinger | |
| 5,134,736 | A | 8/1992 | Anthony et al. | |
| 5,321,862 | A * | 6/1994 | Campbell | 5/482 |
| 5,566,411 | A | 10/1996 | Eiler | |
| 5,794,285 | A | 8/1998 | Burch | |
| 5,884,349 | A * | 3/1999 | Gretsinger | 5/502 |
| 6,098,219 | A | 8/2000 | Milber | |
| 6,108,836 | A | 8/2000 | Keene, III | |
| 6,122,783 | A | 9/2000 | Herndon | |
| 6,233,764 | B1 | 5/2001 | Orr | |
| 6,427,266 | B2 | 8/2002 | Talley-Williams | |
| 6,490,741 | B1 | 12/2002 | Wheeler | |
| 6,502,285 | B2 * | 1/2003 | Kiely | 24/433 |
| 6,611,973 | B2 | 9/2003 | Connell | |
| 6,651,278 | B2 | 11/2003 | Ghanem | |
| 6,757,923 | B2 | 7/2004 | Sopher et al. | |

(Continued)

FOREIGN PATENT DOCUMENTS

WO WO2007/023256 A1 * 3/2007

*Primary Examiner* — Robert G Santos
*Assistant Examiner* — Nicholas Polito
(74) *Attorney, Agent, or Firm* — Wasserbauer Law LLC; Damian Wasserbauer

(57) ABSTRACT

A bed covering system is disclosed comprising an upper sheet and a lower sheet wherein the lower sheet fits on a mattress in a removable manner. The upper sheet is connected to the lower sheet through expandable flaps of material. A zipper runs between the sides of the upper and lower sheets such that when it is zipped, the upper sheet is pulled tightly against the lower sheet but when it is unzipped the upper sheet is allowed to move away from the lower sheet to the extent of the expandable flaps or material.

33 Claims, 1 Drawing Sheet

U.S. PATENT DOCUMENTS 6,886,197 B1 * 5/2005 Madigan ..... 5/482
7,152,259 B1 12/2006 Goodwin
7,159,258 B2 1/2007 Huang
7,290,301 B2 11/2007 Ho
7,849,534 B2 * 12/2010 Bellick et al. ..... 5/413 R
2004/0216231 A1 11/2004 Rao

* cited by examiner

BED COVERING SYSTEM

PRIORITY

This patent application claims the benefit of Provisional U.S. Patent Application No. 61/139,948 which was filed on Dec. 22, 2008.

BACKGROUND OF THE INVENTION

The present invention relates generally to an apparatus and system for covering any mattress style bed (with or without a box spring) in a quick, efficient and neat manner. The bedding and system described allows the user to quickly and easily make a bed in its entirety (sheets, blankets, comforters and pillow(s), placed, balanced and taught), in a repeatable manner using a one or two "zip" process regardless of the users' age, physical restrictions and/or lack of regard to detail.

The system described also adds the safety feature of preventing a child, elderly, convalescent or hospitalized person from falling out of bed once swaddled or tucked in via the "zipper" or fasteners. If unsecured by the zipper, the new bedding system's pocketed design will cradle the fall so that the child and/or adult is less likely to be harmed if they were to fall off of the mattress. The expandable pocket will act as a sling or harness to catch the user falling from the mattress.

While the user(s) is sleeping, the described bedding will prevent displacement or removal of the bed linens and pillow (s).

The described system may also provide an attached pocketed organizer for the user's personal items (i.e.: glasses, book, remote control, cell phone, etc.), an opened area for exiting one leg or foot out from under the bedding if desired and vented area(s) in order to cool off without removing the covers.

As is well known, various types of bed coverings such as sheets, blankets and comforters have been used for ages. Generally a lower sheet is applied to the mattress. The lower sheet can be flat and tucked around the mattress or "fitted" to the mattress. An upper sheet is then applied by tucking it around the mattress which is now covered with the lower sheet. After this, a blanket or blankets are positioned over, and then tucked around the sheet covered mattress and the comforter or top covering is then positioned on top of the entire assembly, usually by neatly draping it over the assembly.

The main problems with the typical bedding described above are that the various pieces (i) are time consuming to apply and reapply correctly, (ii) require substantial work, often strenuous to back muscles, to apply and remake correctly, (iii) easily come undone from the bed (i.e.: if sat on, jumped on, slept in or via any other disturbance), (iv) are difficult to position correctly and keep neat, and (v) often require repeated access to various parts of the bed to position. Various attempted improvements have been suggested. In this regard, please refer to U.S. Pat. No. 6,490,741 to Wheeler; U.S. Pat. No. 6,427,266 to Talley-Williams; and U.S. Pat. No. 5,794,285 to Burch. While these suggested improvements claim to solve some of the foregoing problems, none of them effectively address all of the issues and as a result they have not met with substantial commercial success.

Thus, all current known bedding systems suffer from significant issues which have not been effectively addressed by proposed improvements to date. However, the bedding system proposed by this invention resolves the issues that have arisen from the making of, sleeping in, washing, and reapplying as well as resolving the absence of any safety features that target various at risk groups mentioned above of existing bedding systems. In doing so the proposed invention significantly departs from conventional concepts and designs for bedding and is designed to assist the user(s) in quickly, efficiently and neatly securing the bedding materials to the bed, in an aesthetic manner with little likelihood of disturbing the finished aesthetics without the user choosing to do so.

SUMMARY OF THE INVENTION

It is an object to this invention to disclose bed covering materials in a one piece system, plus accessories and/or attachments that may quickly and efficiently be applied to a bed with minimum physical or cognitive effort.

It is further an object of this invention to disclose bed covering materials in a one piece system, plus accessories and/or attachments, that may not require continuous access to all portions of the bed to make the bed neatly and that more steadyfastly remain in position when applied.

It is further an object of this invention to disclose bed covering materials in a one piece system, plus accessories and/or attachments, that may aid in tucking someone in and provide safety features which may secure young children, convalescent, disabled, challenged or hospitalized users from falling out of bed.

It is further an object of this invention to disclose bed covering materials in a one piece system, plus accessories and/or attachments, that aid in keeping all of the bed linens from being removed or pulled off the user(s) while the user(s) is in the bed.

It is further an object of this invention to disclose bed covering materials in a one piece system, plus accessories and/or attachments, that may keep the pillow(s) independent of each other, yet still secured in their proper position at all times. The design also allows for the user to reposition the pillow in or out of their way in that the user may choose to utilize or not utilize that pillow, although it will remain attached to the bed. If the user chooses not to utilize the attached pillow encasement, then the user(s) pillow if they so choose to use one, will remain free.

It is further an object of this invention to disclose bed covering materials in a one piece system, plus accessories and/or attachments, that provides a secure, attached pocketed storage area on one or more sides of the bed for the user to conveniently hold personal possessions while in or not in the bed.

It is further an object of this invention to disclose bed covering materials in a one piece system, plus accessories and/or attachments, that prevents the bedding from becoming displaced by restless sleep or by a second user during the time the user(s) are in or on top of the bed alone or together.

It is further an object of this invention to disclose bed covering materials in a one piece system, plus accessories and/or attachments, that may or may not provide a venting capability at the foot and/or sides of the bed.

It is further an object of this invention to disclose bed covering materials in a one piece system, plus accessories and/or attachments, that may be easily made and unmade by some, all or none of the following depicted users: a user as young as 3 to 4 years of age, a user with restricted back problems or limited range of motion, a physically or mentally challenged user, an elderly user and/or a blind user, that may otherwise experience difficulty making a bed via conventional methods offered today.

It is yet further an object of this invention to disclose bed covering materials in a one piece system, plus accessories and/or attachments that are aesthetically pleasing and will remain so with minimal attention.

It is yet further an object of this invention to disclose bed covering materials in a one piece system, plus accessories and/or attachments, that minimizes the amount of time necessary to make, disassemble, wash and reaffix the bedding and that requires minimum maintenance to keep it in a functional and neat in appearance once made.

It is further an object of this invention to disclose bed covering materials in a one piece system, plus accessories and/or attachments, that provides a re-useable template and fasteners in which a single user may, if they so choose, adapt existing top covers or bedding to the one piece system.

It is further an object of this invention to disclose bed covering materials in a one piece system that may provide a safety zipper allowing for "quick release emergency exit". It is further an object of this invention to disclose bed covering materials in a one piece system, to add a zipper or other chosen fastener that is machine washable, non-rusting and that is sewn in such a way that the zipper and/or chosen fastener is concealed from touching the user(s) skin once fastened or unfastened, and is not exposed to risk of harm, scratch or other discomfort.

It is further an object of this invention to disclose bed covering materials in a one piece system for use on any manufactured crib mattress. The crib bedding system maintains the one-piece expandable sides, easily and quickly made, unmade, washed and reattached design with the possible absence of one or more of the above described features. The materials used are to be safety rated materials as required by law in the production of children's bedding. The crib version of the described design may include a satin edge (the width to be determined based on safety factors) and the use of a baby safe fastener and or loop that can be used to attach a pacifier, bottle or baby toy.

These and other objectives and advantages are achieved by bedding materials comprising:

(1) a lower sheet layer which is shaped to fit upon and substantially cover the top, sides and preferably a portion of the underside of any mattress and/or mattress—box spring combinations regardless of size, such that it removably, attaches to the mattress and/or box spring;

(2) an upper sheet that is attached to the lower sheet on two or more sides either directly or through an expandable flap;

(3) at least one attachment means, such as a zipper, which runs along at least one edge of the bedding material, such that when the zipper is zipped, the expandable flap of the bedding system tucks neatly along the bed side(s) behind the attachment means, allowing the upper sheet to be pulled tightly against the lower sheet, but when unzipped, allows the upper sheet to move away from the lower sheet to the extent allowed by the expandable flap.

As used herein and in the claims, the word, "sheet", including upper sheet and lower sheet shall include mattress or bed coverings made from various fabrics or materials and shall not be limited to typical sheet materials such as cotton or flannel.

BRIEF DESCRIPTION OF THE DRAWINGS

The figures presented herein are illustrations of various aspects of the proposed bedding materials but should not be considered limiting of the scope of the invention.

DETAILED DESCRIPTION OF THE INVENTION

Figure 1:
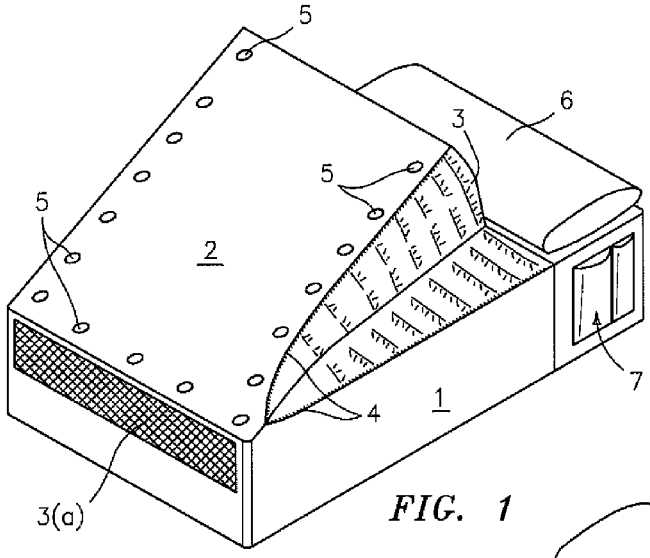
FIG. 1 is an expanded view of bedding materials proposed in this invention.
Figure 2:
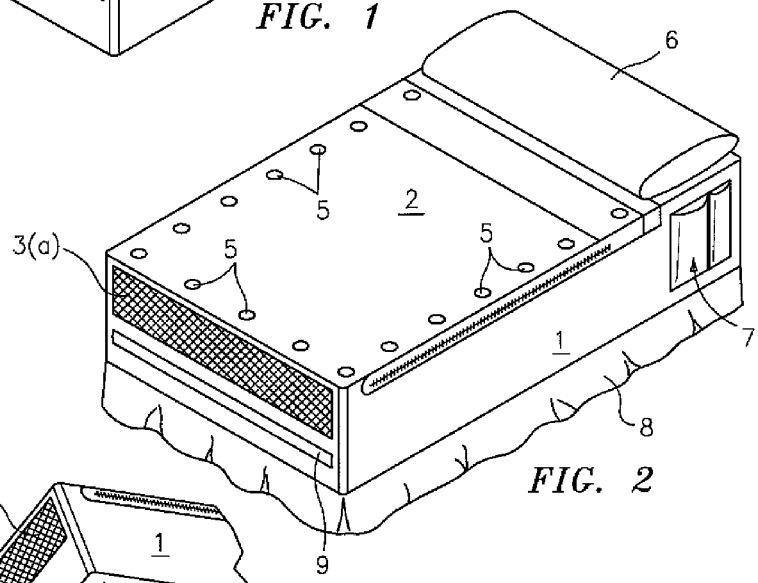
FIG. 2 is a view of the bedding materials as applied to a made up bed.
Figure 3:
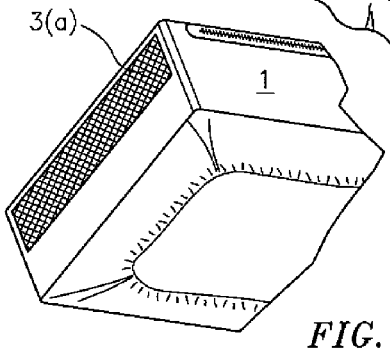
FIG. 3 is a view showing the underside of the mattress in one embodiment.

The proposed improved bed covering system comprises:

(1) A lower sheet, comprising four sides, which is shaped to fit upon and substantially cover the top and side portions of a mattress and/or box spring such that the lower sheet removably attaches to the mattress;

(2) an upper sheet comprising four edges that is attached to the lower sheet on at least two sides of the lower sheet either directly or through expandable portions, flaps, or folds of material; and (3) at least one attachment means, such as a zipper, comprising a lower zipper portion which runs along at least one side of the lower sheet, expandable portions, flaps, or folds of material, and an upper zipper portion which runs along at or near at least one edge of the upper sheet.

wherein when the zipper is zipped it pulls the upper sheet tightly against the lower sheet but when the zipper is unzipped, it allows the upper sheet to move away from the lower sheet to the extent allowed by the expandable portions, flaps, or folds of material. As used herein, expandable flap shall mean expandable flaps, portions or folds of material. The expandable flap comprises a stretchable material which allows the upper sheet to move away from the lower sheet when the attachment means is open.

In the alternative, instead of a zipper any other attachment means such as VELCRO® hook and loop fastener, snaps or buttons can be used to attach the upper sheet to a side of the lower sheet. When the attachment means is closed (i.e. connected), the upper sheet is pulled tightly against the lower sheet. When the attachment means is open (i.e. unattached), it allows the upper sheet to move away from the lower sheet to the extent allowed by the expandable flaps. The attachment means should comprise two portions. One portion runs along at least one side of the lower sheet and the other portion runs along at or near at least one corresponding edge of the upper sheet. When one portion of the attachment means is connected to the other portion of the attachment means, the means is closed and the upper sheet is pulled tightly against the lower sheet. When the two portions of the attachment means are unattached, it is opened and the upper sheet is allowed to move away from the lower sheet to the extent of the expandable flaps.

Lower sheet (1) may be fabricated from any standard sheet materials such as cotton, linen, flannel or satin. It comprises (i) a major surface which covers the top of the mattress and (ii) four sides which cover the sides of the mattress and/or box spring. Lower sheet (1) preferably comprises four elastic portions located at the lower corners of each of the sides of lower sheet (1), preferably able to be tucked well under the mattress and/or box spring. These elastic portions are most preferably located at each of lower four corners of lower sheet (1) and fit over the four corresponding lower corners of the mattress. These elastic portions preferably fit over the lower corners of the mattress so as to removably attach the lower sheet to the mattress in a manner similar to a fitted sheet. The lower sheet is fabricated and shaped to fit snugly over the mattress such that it is removeably attached to the mattress.

In the alternative, lower sheet (1) can be shaped such that the mattress fits within the lower sheet's inner cavity. In this embodiment, the lower sheet (1) forms a cavity on its interior and the mattress is slipped into the cavity of the lower sheet (1) via an opening (9) in one side of the lower sheet.

The upper sheet (2) may similarly be fabricated and from standard sheet materials such as cotton, linen, flannel or satin. In the alternative, the upper sheet (2) may be fabricated from any blanket material or from comforter materials as exists presently in a blanket or comforter or featherbed. Upper sheet (2) comprises (i) a major surface which is located above or lies on top of the major surface of the lower sheet (1) and (ii) four edges. At least two of the edges of upper sheet (2) are attached through expandable flap (3), to the corresponding two sides of lower sheet (1). The fourth edge of upper sheet (2) is not attached to lower sheet (1).

If an edge of upper sheet (2) is attached directly to lower sheet (1) it can be attached by attachment means including but not limited to sewing, zipper, VELCRO® hook and loop fastener, buttons or snaps. If an edge of upper sheet (2) is attached to an expandable flap, then the expandable flap is attached to both an edge of upper sheet (2) and a side of lower sheet (1) by an attachment means including but not limited to sewing, zipper, VELCRO® hook and loop fastener, buttons or snaps.

The bedding materials preferably comprise at least one expandable flap (3) located between at least one edge of upper sheet (2) and a side of lower sheet (1). More preferably, the bedding materials comprise at least two expandable flaps (3) located between the edges of upper sheet (2) and the sides of lower sheet (1) which run along the two sides of the bed where persons enter and exit the bed. Most preferably the bedding materials comprise two expandable flaps along the two sides of the bed where persons enter and exit the bed as noted previously and one expandable flap 3(*a*) located between the edge of upper sheet (2) and the side of lower sheet (1) at the foot of the bed. The expandable flaps of material (3) can be made of a stretchable material which will allow the upper sheet to move away from the lower sheet by a specified distance. The expandable flap (3) in this regard can also be an integral part of the upper sheet (2), with no clear demarcation between the upper sheet (2) and the expandable flap (3). The expandable flaps (3) can be made of an elastic fabric which stretches when force is applied. Preferably the expandable flap or flaps located along the sides of the bed where persons enter and exit the bed The expandable flaps may be attached to the upper sheet and the lower sheet by an attachment means such as sewing a zipper, Velcro or snaps to them. Optionally, the expandable flap may have a slit in a portion of the expandable flap which will allow a user to place a leg outside of the bedding materials, through the slit, while sleeping.

The bedding materials also comprise at least one attachment means, such as a zipper (4), preferably two zippers, with the zipper or zippers located on the sides of the bedding materials corresponding to where people normally enter and exit the bed. The zipper (4) comprises an upper zipper portion and a lower zipper portion. The upper zipper portion runs along at or near at least one of the edges of upper sheet (2) where people normally enter and exit the bed and the lower zipper portion runs along the corresponding side of lower sheet (1). The zipper (4) is situated such that when it is zippered, it pulls upper sheet (2) into close contact with lower sheet (1), and expandable flap (3) folds, contracts, or tucks neatly behind zipper (4). When unzippered, zipper (4) releases expandable flap (3) and thus upper sheet (2) so that upper sheet (2) can move freely above lower sheet (1) to the extent of expandable flap (3). The zipper (4) can also be partially zippered to control the available play between upper sheet (2) and lower sheet (1). For appearance and neatness it is important that the expandable flap folds, contracts or tucks behind the zipper (i.e, fold in towards the mattress) so that it is hidden and pulled together when the zipper is zipped. As noted, it is preferable that the bedding materials comprise two zippers and two expandable flaps with one located on each side of the bedding materials where persons normally enter and exit from the bed. As alternatives to the zipper, the bedding materials may use equivalent attachment means such as VELCRO® hook and loop fastener, snaps, hooks or buttons. The zipper is preferred for its ease, safety and reliability. If attachment means other than a zipper are used, the attachment means will generally have two portions such as a row of button holes and a corresponding row of buttons, or a row of male snaps and a corresponding row of female snaps, or corresponding strips of VELCRO® hook and loop fastener. One portion runs along at least one side of the lower sheet and the other portion runs along at or near at least one corresponding edge of the upper sheet. When one portion of the attachment means is connected to the other portion of the attachment means, the means is closed and the expandable flap folds in behind the attachment means while the upper sheet is pulled tightly against the lower sheet. When the two portions of the attachment means are unattached, it is open and the expandable flap is released to allow the upper sheet to move away from the lower sheet to the extent of the expandable flap.

The upper sheet (2) may optionally comprise snaps, buttons, hooks, VELCRO® hook and loop fastener or other connection means (5) which are located near the edges of upper sheet (2), These snaps or buttons (5) can he used to attach an additional blanket and/or a bed covering to upper sheet (2) which is part of the original one piece system of the invention. An additional blanket or bed covering may be provided with corresponding connection means which correspond with, and attach to, the connection means (5) on the upper sheet (2).

The edge of upper sheet (2) and the side of lower sheet (1) which are located at the foot of the bed can optionally be connected to each other through an expandable flap, 3(*a*). Flap 3(*a*) is preferably made from a stretchable fabric or stretchable fabric mesh. In the alternative, a slit or opening can be placed in flap 3(*a*) at the foot of the bed for air flow.

The sides of lower sheet (1) can optionally have pocket (7) which are preferably fabricated from the same material as lower sheet (1). Pocket (7) can be used to hold or store various items such as a television control or glasses. Pocket (7) is preferably located on the side(s) of lower sheet (1) near the head of the bed for easy access. More than one pocket can be used on each side.

Lower sheet (1) may also optionally have a pillow or pillow encasement (6) attached to it on its major surface at the head of the bed. Preferably the pillow or pillow encasement (6) are removeably attached to the lower sheet (6) by snaps or buttons (not shown).

The lower sheet (1) may also optionally comprise a dust ruffle (8) which is attached at the bottom of the sides of lower sheet (1). This dust ruffle serves the aesthetic purpose of covering the sides of the bed and the functional purpose of minimizing dust accumulation under the bed.

We claim:

1. A bed covering system comprising:

(a) a lower sheet, comprising a major surface and four downwardly extending sides of a head, a front, and two longitudinal sides where persons enter and exit the bed, shaped to fit upon and substantially cover the top and side portions of a mattress such that the lower sheet removably attaches to the mattress, and a pocket on at least the two sides;

(b) an upper sheet, comprising a major surface and four edges, that is attached to the lower sheet directly on the front and on the two longitudinal sides through expandable flaps of material, wherein the expandable flaps of material comprise an elastic fabric which stretches when force is applied and located along the two sides;

(c) at least one attachment means which, can be open or closed, and attaches the upper sheet to each of the two longitudinal sides of the lower sheet;

wherein when the attachment means is closed the upper sheet is pulled tightly against the lower sheet and the expandable flaps of material tuck, fold or contract neatly along the two longitudinal sides of a bed so that each of the expandable flaps of material are hidden and pulled together behind the attachment means in the pocket of the lower sheet, but when the attachment means is open it allows the upper sheet to move away from the lower sheet to the extent allowed by the expandable flap of material.

2. A bed covering system according to claim 1 wherein the attachment means comprises at least one zipper comprising (i) a lower zipper portion which runs along at least one side of the lower sheet and (ii) an upper zipper portion which runs along at or near at least one edge of the upper sheet, such that when the zipper is zipped, it pulls the upper sheet tightly against the lower sheet but when the zipper is unzipped, it allows the upper sheet to move away from the lower sheet to the extent allowed by the expandable flap of material.

3. A bed covering system according to claim 2 wherein the lower sheet comprises four elastic portions located at the lower corners of each of the sides of the lower sheet such that the elastic portions fit over the corresponding corners of the mattress to removably attach the lower sheet to the mattress.

4. A bed covering system according to claim 2 wherein the mattress fits within a cavity, formed by the lower sheet, through an opening in one of the sides of the lower sheet.

5. A bed covering system, according to claim 2 wherein the expandable flaps of material comprise a slit or opening at the foot and/or sides of the bed which will allow for air flow and a user to place a leg outside of the bed covering system.

6. A bed covering system according to claim 2 wherein the upper sheet comprises snaps, buttons or hook and loop fastener, near its edges, which can be used to attach a blanket or a bed covering to the upper sheet.

7. A bed covering system according to claim 6 wherein the bed covering system also comprises a blanket or bed covering comprising connection means which correspond and attach to the snaps, buttons or hook and loop fastener.

8. A bed covering system according to claim 2 wherein the lower sheet comprises at least one pillow encasement removably attached to the major surface of the lower sheet near the head of the mattress.

9. A bed covering system according to claim 2 wherein the bottom sheet also comprises a dust ruffle attached at the bottom of the four sides of the lower sheet.

10. A bed covering system, according to claim 2 wherein the expandable flaps of material comprise a slit or opening at the foot and/or sides of the bed which will allow for air flow and a user to place a leg outside of the bed covering system.

11. A bed covering system according to claim 1 wherein the lower sheet comprises four elastic portions located at the lower corners of each of the sides of the lower sheet such that the elastic portions fit over the corresponding corners of the mattress to removably attach the lower sheet to the mattress.

12. A bed covering system according to claim 11 wherein the upper sheet comprises snaps, buttons or hook and loop fastener, near its edges, which can be used to attach a blanket or a bed covering to the upper sheet.

13. A bed covering system according to claim 12 wherein the bed covering system also comprises a blanket or bed covering comprising connection means which correspond and attach to the snaps, buttons or hook and loop fastener.

14. A bed covering system according to claim 11 wherein the upper sheet comprises at least one pillow removably attached to the major surface of the upper sheet near the head of the mattress.

15. A bed covering system according to claim 11 wherein the bottom sheet also comprises a dust ruffle attached at the bottom of the four sides of the lower sheet.

16. A bed covering system according to claim 1 wherein the mattress fits within an inner cavity, formed by the lower sheet, through an opening in one of the sides of the lower sheet.

17. A bed covering system, according to claim 16 wherein the expandable flaps of material comprise a slit or opening at the foot and/or sides of the bed which will allow for air flow and a user to place a leg outside of the bed covering system.

18. A bed covering system according to claim 16 wherein the upper sheet comprises snaps, buttons or hook and loop fastener, near its edges, which can be used to attach a blanket or a bed covering to the upper sheet.

19. A bed covering system according to claim 18 wherein the bed covering system also comprises a blanket or bed covering comprising connection means which correspond and attach to the snaps, buttons or hook and loop fastener.

20. A bed covering system according to claim 16 wherein at least one side of the lower sheet comprises a pocket.

21. A bed covering system according to claim 16 wherein the lower sheet comprises at least one pillow encasement removably attached to the major surface of the lower sheet near the head of the mattress.

22. A bed covering system according to claim 16 wherein the lower sheet also comprises a dust ruffle attached at the bottom of the four sides of the lower sheet.

23. A bed covering system, according to claim 1 wherein the expandable flaps of material comprise a slit or opening at the foot and/or sides of the bed which will allow for air flow and a user to place a leg outside of the bed covering system.

24. A bed covering system according to claim 23 wherein the upper sheet comprises snaps, buttons or hook and loop fastener, near its edges, which can be used to attach a blanket or a bed covering to the upper sheet.

25. A bed covering system according to claim 24 wherein the bed covering system also comprises a blanket or bed covering comprising connection means which correspond and attach to the snaps, buttons or hook and loop fastener.

26. A bed covering system according to claim 23 wherein the lower sheet comprises at least one pillow encasement removably attached to the major surface of the lower sheet near the head of the mattress.

27. A bed covering system according to claim 23 wherein the bottom sheet also comprises a dust ruffle attached at the bottom of the four sides of the lower sheet.

28. A bed covering system according to claim 1 wherein the bed covering system comprises at least two expandable flaps of material which are located along the sides of the lower sheet where persons normally enter and exit a bed.

29. A bed covering system according to claim 1 wherein the upper sheet comprises snaps, buttons or hook and loop fastener, near its edges, which can be used to attach a blanket or a bed covering to the upper sheet.

30. A bed covering system according to claim 29 wherein the bed covering system also comprises a blanket or bed covering comprising connection means which correspond and attach to the snaps, buttons or hook and loop fastener.

31. A bed covering system according to claim 1 wherein the lower sheet comprises at least one pillow encasement removably attached to the major surface of the lower sheet near the head of the mattress.

32. A bed covering system according to claim 1 wherein the bottom sheet also comprises a dust ruffle attached at the bottom of the four sides of the lower sheet.

33. A bed covering system according to claim 1 wherein the attachment means comprises a safety zipper to release an edge of the expandable flap which allows for quick release and exit in case of emergency.

* * * * *